US006521849B1

(12) United States Patent
Flegel

(10) Patent No.: US 6,521,849 B1
(45) Date of Patent: Feb. 18, 2003

(54) LEVER AND LINKAGE INTERLOCK FOR PARALLEL OFFSET SWITCHES

(75) Inventor: David D. Flegel, Racine, WI (US)

(73) Assignee: Reliance Controls Corporation, Racine, WI (US)

( * ) Notice: Subject to any disclaimer, the term of this patent is extended or adjusted under 35 U.S.C. 154(b) by 0 days.

(21) Appl. No.: 09/819,311

(22) Filed: Mar. 28, 2001

(51) Int. Cl.[7] ..... H01H 9/20
(52) U.S. Cl. ..... 200/50.32; 200/50.33
(58) Field of Search ..... 200/43.01, 43.16, 200/50.32, 50.33, 50.37, 50.4

(56) References Cited

U.S. PATENT DOCUMENTS

| | | | | | |
|---|---|---|---|---|---|
| 3,789,169 | A | * | 1/1974 | Yazvac | 200/50.33 |
| 4,902,859 | A | | 2/1990 | Witzmann et al. | 200/50 |
| 4,924,041 | A | | 5/1990 | Yee | 200/50 |
| 5,008,499 | A | * | 4/1991 | Yee et al. | 200/50.33 |
| 5,648,646 | A | | 7/1997 | Flegel | 200/50.32 |
| 5,814,777 | A | | 9/1998 | Green et al. | 200/50.33 |
| 5,977,492 | A | | 11/1999 | Taylor et al. | 200/50.32 |
| 6,043,439 | A | | 3/2000 | Crooks et al. | 200/50.33 |
| 6,096,986 | A | * | 8/2000 | Flegel | 200/50.33 |

* cited by examiner

*Primary Examiner*—Michael Friedhofer
(74) *Attorney, Agent, or Firm*—Boyle, Fredrickson, Newholm, Stein & Gratz S.C.

(57) ABSTRACT

An interlock assembly for first and second switch mechanisms which respectively have first and second switch members or handles oriented such that the switch members are offset and are movable parallel to one another between ON and OFF positions. The interlock assembly is movable between first and second interlock positions. The interlock assembly is configured such that, when in its first interlock position, the first switch member is movable between its ON position and OFF positions and the second switch member is prevented from movement to its ON position. In its second interlock position, the interlock assembly allows movement of the second switch member between its ON and its OFF positions and prevents movement of the first switch member towards its ON position. The interlock assembly is in the form of first and second interlock members pivotally secured to a support arrangement and a linkage arm interconnecting the first and second interlock members.

18 Claims, 4 Drawing Sheets

12

114
120
122
126
128
144
142
118
38
130
146
148
136
116
124
132
138
140
134
100
76
98
102
110
84
113
88
170
90
86
96
74
112
150
40
94
92
107
72
36
106
80
78
105
160
111
103
60
82
162
52
166
109
168
158
156
164
48
154
152
64
50
34
54
42
58
66
46
56
44

LEVER AND LINKAGE INTERLOCK FOR PARALLEL OFFSET SWITCHES

FIELD OF THE INVENTION

This invention relates to an interlock for switches, and more particularly pertains to an interlock for two switch members in an electrical panel for preventing both switch members from being in an ON position at the same time.

BACKGROUND OF THE INVENTION

In an electrical supply system, it is known to provide an alternate source of electrical power in order to supply power to an electrical load in the event of a power outage. For example, in a system in which the primary power supply is utility power, it is desirable to supply power from an alternate source, such as a generator, to continue an uninterrupted power supply to the electrical load in the event of a power outage. When supplying an alternate source of power in this manner, it is known to connect the alternate power supply to a circuit breaker-type switching mechanism. The primary power supply is also interconnected with a circuit breaker-type switching mechanism, and each switching mechanism includes a switch member movable between an ON position and OFF position for controlling connection of utility power and power from the alternate source to the electrical load.

In one arrangement, the switch mechanisms are aligned with each other and the switch members are movable toward each other to an ON position and away from each other to an OFF position. A linkage-type interlock mechanism is interposed between the switch members for preventing both switch members from being in the ON position at the same time. An example of this type of interlock is shown in Flegel U.S. Pat. No. 5,648,646 issued Jul. 15, 1997, the disclosure which is hereby incorporated by reference. Other interlocks of this type are illustrated in Flegel U.S. Pat. 6,096,986 issued Aug. 1, 2000 and U.S. Pat. No. 6,031,193 issued Feb. 29, 2000, the disclosures of which are hereby incorporated by reference.

In another form, the primary power supply, such as utility power, is interconnected with a switch mechanism having a switch member movable in a first direction, and power from an alternate source such as a generator, is supplied to a switch mechanism having a switch member which moves in a direction transverse to that of the switch member of the utility power supply switch mechanism. In a situation such as this, a transverse interlock mechanism is interconnected with the utility power supply switch mechanism and the generator power supply switch mechanism. An interlock of this type is shown and described in Flegel U.S. Pat. No. 6,184,595 issued Feb. 6, 2001, the disclosure which is hereby incorporated by reference.

Some electrical panels or load centers include a primary power supply switch mechanism which utilizes a switch member movable in a back and forth manner in the same direction as the switch member of the auxiliary or generator power supply switch mechanism, and in which the switch members are offset from each other. An interlock is provided to prevent the primary power supply and generator power supply switch mechanisms from being in the ON position simultaneously. An interlock of this type is shown and described in Taylor U.S. Pat. No. 5,977,492 issued Nov. 2, 1999.

It remains desirable to provide an interlock mechanism which prevents two circuit breakers in parallel offset relation to each other, and possibly of different sizes, from being turned ON simultaneously. It is also desirable that the interlock mechanism permits both of the circuit breakers to be switched OFF at the same time.

Accordingly, it is an object of the present invention to provide an improved switch interlock which is adapted for use with switch members which are offset from each other and movable in parallel directions. It is a further object of the present invention to provide such an interlock which prevents supply of power to an electrical load center of panel from two power sources at the same time. Yet another object of the invention is to provide such an interlock which allows the switch members to both be in an OFF position at the same time. Yet another object of the invention is to provide such an interlock which is easily adaptable to commonly available switch mechanisms and electrical panels. A still further object of the invention is to provide such an interlock which is relatively simple in its components and construction and is adaptable in other switching applications.

SUMMARY OF THE INVENTION

The present invention advantageously provides an interlock for circuit breaker-type switch members installed in a standard electrical load center panel for the purpose of providing a safe and simple arrangement for providing power to the selected circuits from an alternate power source, such as a portable generator, during a utility power outage. The present invention enables the use of standard, off-the-shelf circuit breakers arranged so that their handles move in the same direction.

In accordance with one aspect of the invention, an electrical load center or panel includes a first switch mechanism including a switch member movable in a first direction, and a second switch mechanism including a switch member laterally offset or spaced from the first switch member and movable in generally the same direction as the first switch member. Both switch members are movable between an ON position and an OFF position, and may be associated with circuit breaker mechanisms which control the supply of electrical power to the electrical load center or panel from first and second power sources, respectively. An interlock mechanism is interconnected between the first switch mechanism and the second switch mechanism to prevent movement of the second switch member to an ON position when the first switch member is in the ON position. The interlock mechanism also prevents movement of the first switch member to its ON position when the second switch member is in its ON position. In a preferred embodiment, the interlock mechanism includes a support arrangement adapted for mounting adjacent the first and second switch mechanisms. The interlock mechanism includes a lever and linkage interlock assembly movably mounted on the support arrangement for pivotal movement between first and second positions. In the first position, the interlock assembly allows the first switch member to freely move between its ON and OFF positions and block movement of the second switch member away from its OFF position. The interlock assembly is movable to a second position when the first switch member is in its OFF position. When in its second position, the interlock assembly is moved into the path of the first switch member, such that the second switch member can be moved from its OFF position to its ON position and the first switch member is prevented from movement away from its OFF position. In a preferred embodiment, the first and second switch mechanisms include first and second manually operable switch handles, and the interlock mechanism is connected between the first and second switch handles.

The interlock assembly includes a first interlock member preferably in the form of a blocking lever which is pivotally mounted on the support arrangement, and is engageable with the first switch handle. A second interlock member preferably in the form of an actuating lever is also pivotally mounted to the support assembly, and is engageable with the second switch handle and movable therewith. A linkage arm interconnects the first and second interlock members. The first and second interlock members include engagement structure to prevent movement of the second switch handle to an ON position when the first switch handle is in an ON position, and to prevent movement of the first switch handle to an ON position when the second switch handle is in an ON position.

The blocking lever may be in the form of a substantially planar member having a first engagement surface engageable with the first switch handle when the first switch mechanism is in its ON position, for preventing movement of the second switch handle to its ON position. The blocking lever also has a second engagement surface engageable with the first switch handle when the first switch mechanism is in its OFF position and the second switch mechanism is in its ON position, for preventing movement of the first switch handle to its ON position. The actuating lever is formed with an opening for receiving the second switch handle. The actuating lever includes a first engagement post engageable with one side of the second switch handle, a second engagement post engageable with another side of the second switch handle and a third engagement post adapted to being engaged by the user when it is desired to move the second switch handle by moving the actuating lever. The first, second and third posts may be located about the periphery of the opening in the actuating lever.

When the first switch handle is in its ON position, application of a force tending to move the second switch handle mechanism from its OFF position causes the second switch handle to contact the actuating lever, tending to pivot the actuating lever. The force is transmitted via the linkage arm to the blocking lever, and moves the first engagement surface of the blocking lever into engagement with the first switch handle to prevent movement of the second switch handle toward its ON position. When the first switch handle is in its OFF position, application of a force tending to move the second switch handle from its OFF position causes the second switch handle to contact the actuating lever, tending to pivot the actuating lever. The force is transmitted via the linkage arm, and moves the blocking lever to a position in which the second engagement surface of the blocking lever is in alignment with the first switch handle, to enable the second switch handle to move to its ON position and to prevent movement of the first switch handle to its ON position while the second switch handle is in the ON position. The second witch handle may be directly engaged by the user for movement between its ON and OFF positions, or the user may employ the first and second engagement posts to cause movement of the second switch handle.

The support arrangement includes a mounting bracket secured to the first switch mechanism, and a base plate assembly to which the interlock assembly is mounted. The base plate assembly is supported by the mounting bracket and the first switch mechanism. A cover plate is attached to the base plate assembly and the mounting bracket in spaced relationship above the interlock assembly.

Another aspect of the invention involves an improvement in an electrical panel including a first switch mechanism having a first switch member movable in a first direction between an ON and OFF position for controlling supply of electrical power from a first source. The improvement contemplates a second switch mechanism having a second switch member movable in a direction parallel to the first direction between an ON and. OFF position for controlling the supply of electrical power from an alternate power source, and an interlock mechanism for controlling movement of the first and second switch members. The interlock mechanism includes first and second interlock members which are movably disposed upon a support arrangement interconnected with the electrical panel. The first and second interlock members are interconnected by a linkage arm which transmits motion from the second switch mechanism and the second interlock member to the first interlock member. Details of this aspect of the invention are substantially as summarized above.

The invention further contemplates a method of preventing movement of a first switch mechanism to an ON position when an adjacent second switch mechanism is in an ON position, substantially in accordance with the foregoing summary.

Various features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
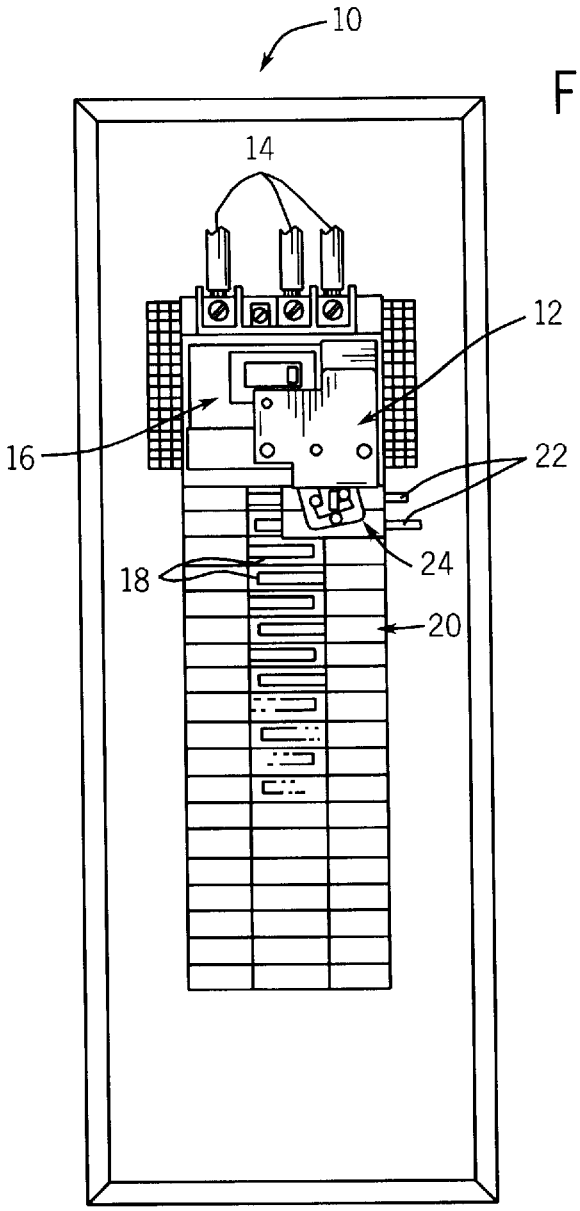
FIG. 1 is a front elevation view of an electrical load center or panel which includes a mounting area for a series of circuit breaker switches as well as power supply switches, and incorporates the interlock mechanism of the present invention.

FIG. 1 illustrates an electrical panel assembly 10 incorporating a lever and linkage interlock mechanism of the invention, shown generally at 12. In a manner as is known, a primary source of electrical power, such as utility power, is supplied to electrical panel assembly 10 through a series of input wires 14, and electrical panel assembly 10 includes a primary circuit breaker switch mechanism 16 which is interconnected with the primary source of electrical power for controlling the supply of electrical power to the electrical panel assembly 10 from the primary electrical power source. Representatively, electrical panel assembly 10 may be a panel assembly such as is available from Square D Company of Palatine, Ill. under its Catalog number Q0140M200. Electrical panel assembly 10 includes a series of circuit breaker stabs 18 which are adapted to supply power to a series of branch circuit breakers interconnected with electrical loads within a building. Electrical panel assembly 10 includes a circuit breaker mounting area 20 to which the individual branch circuit breakers are adapted to be mounted in a manner as is known.

A secondary source of electrical power, such as from a generator, is supplied to electrical panel assembly 10 through wires such as shown at 22. Electrical panel assembly 10 incorporates a secondary circuit breaker switch mechanism 24 removably mounted to circuit breaker mounting area 20 and interconnected with wires 22, for controlling the supply of electrical power to electrical panel assembly 10 from the secondary electrical power source. Secondary switch mechanism 24 may be in the form of a conventional circuit breaker-type switch mounted to circuit breaker mounting area 20 of electrical panel assembly 10, for controlling the supply of electrical power from the secondary electrical power source to electrical panel assembly 10, in a manner as is known.

Primary switch mechanism 16 may be that such as is available from Square D Company of Palatine, Ill. under its Catalog number QOM2200VH, and secondary switch mechanism may be that such as is available from Square D Company of Palatine, Ill. under its Catalog number QO230. It is understood that the specific components are illustrative only, and that other similar components may be employed.

Primary switch mechanism 16 includes a switch body 26 and a spring-biased primary switch member or handle 28 movably mounted to body 26. Primary switch mechanism 16 is removably mounted towards a top end of electrical panel assembly 10, in a manner such that switch handle 28 is movable in a direction perpendicular to the longitudinal axis of electrical panel assembly 10, i.e., in a horizontal direction with reference to FIG. 1. Electrical panel assembly 10 is typically adapted for mounting to a wall or other support structure within a building, such that electrical panel assembly 10 is in a vertical orientation.

Primary switch handle 28 is movable between an ON position in which electrical power is supplied to electrical panel assembly 10 from the primary source of electrical power, and an OFF position for cutting off the supply of electrical power to electrical panel assembly 10. Primary switch handle 28 is shown in its ON position in FIGS. 1, 2, 3 and 5. Similarly, secondary switch mechanism 24 includes a switch body 30 and a spring-biased, secondary switch member or a handle 32 movably mounted to switch body 30. Circuit breaker mounting area 20 is oriented such that secondary switch mechanism 24 is mounted generally parallel to and offset from primary switch mechanism 16. Secondary switch handle 32 is movable relative to switch body 30 in a direction generally parallel to the direction of movement of primary switch handle 28, and the line of movement of secondary switch handle 32 is offset from that of primary switch handle 28. Secondary switch handle 32 is movable between an ON position for supplying power to electrical panel assembly 10 from the secondary source of electrical power, and an OFF position for cutting off power from the secondary power source. In FIGS. 1, 2, 3 and 5, secondary switch handle 32 is shown in its OFF position.

Figure 7:
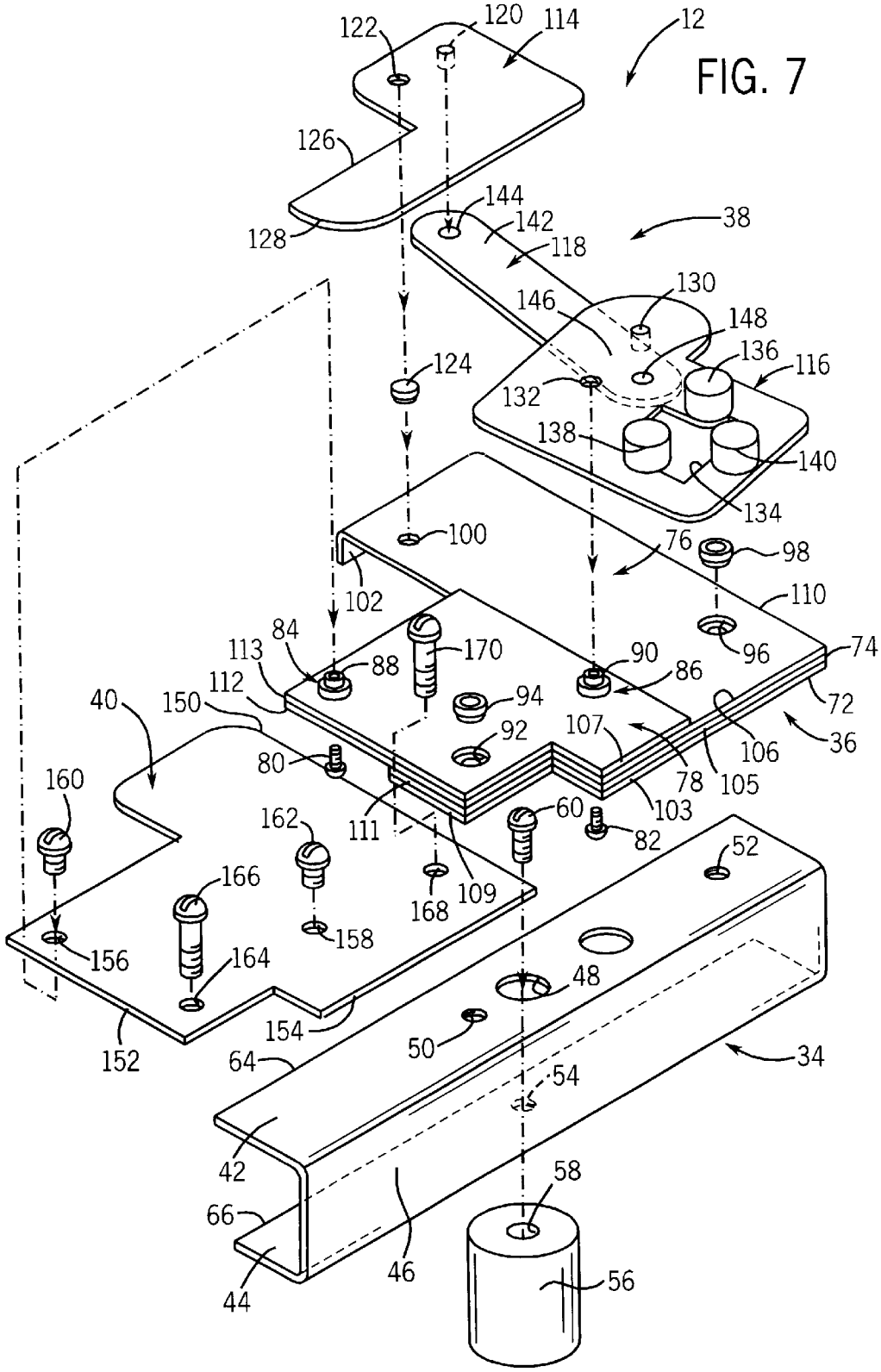
FIG. 7 is an exploded, isometric view of the interlock mechanism.

FIG. 7 illustrates the components of interlock mechanism 12 in exploded fashion. In a manner as will be explained, interlock mechanism 12 is operable to prevent primary and secondary switch handles 28, 32, respectively, from both being in the ON position at the same time, so as to ensure that electrical panel assembly 10 is supplied with electrical power from only one source. In this manner, interlock mechanism 12 is operable to prevent the adverse consequences which may result if both primary switch mechanism 16 and secondary switch mechanism 24 are simultaneously in the ON position.

Generally, interlock mechanism 12 includes a stationary support arrangement incorporating a mounting bracket 34, and a base plate assembly 36 located vertically above mounting bracket 34. An interlock assembly 38 is located vertically above base plate assembly 36 and a cover plate 40 is disposed over the interlock assembly 38.

Figure 8:
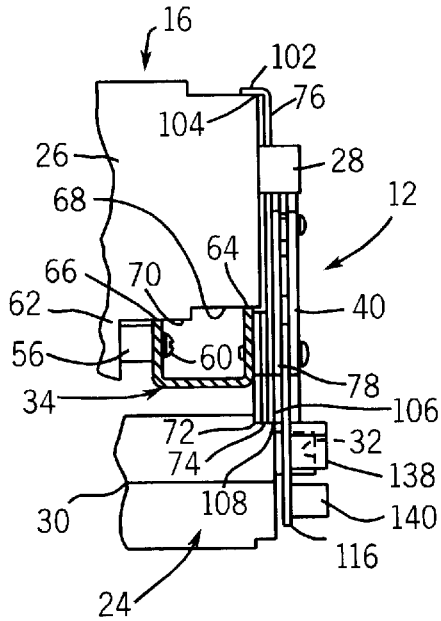
FIG. 8 is a sectional view taken on line 8—8 of FIG. 2.
Figure 2:
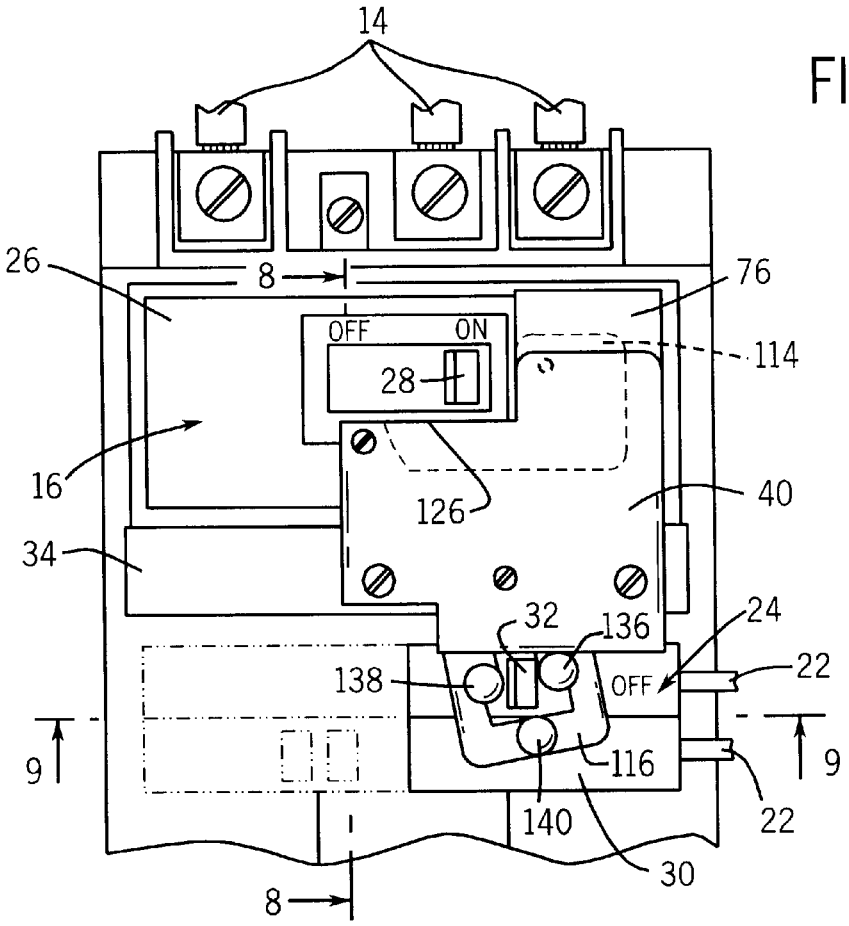
FIG. 2 is an enlarged partial front elevation view of the power supply switches and the interlock mechanism of FIG. 1, showing a first one of the power supply switches in an ON position and a second one of the power supply switches in an OFF position, with the interlock mechanism preventing movement of the second switch to its ON position.
Figure 3:
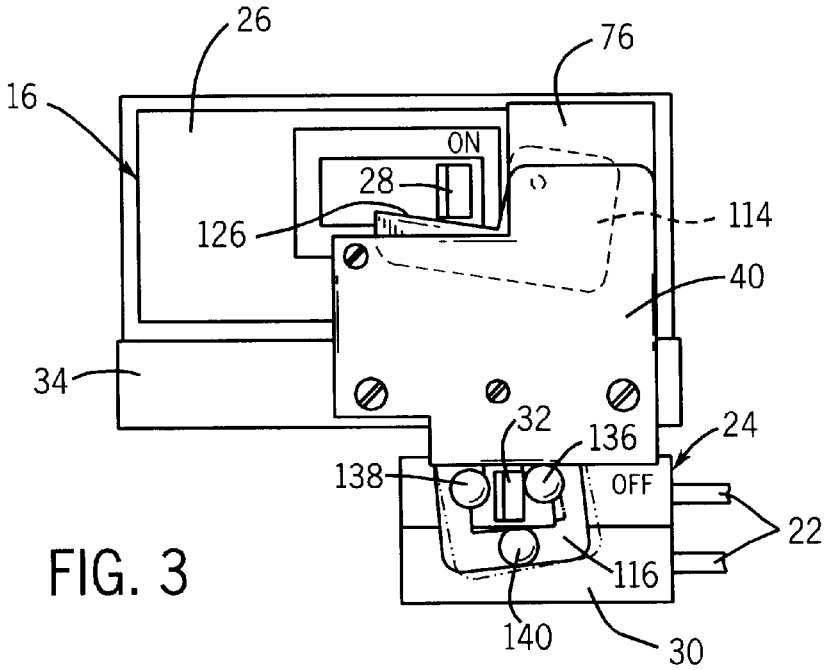
FIG. 3 is a view similar to FIG. 2 showing initial movement of the interlock mechanism for preventing movement of the second switch to its ON position when the first switch is in its ON position.
Figure 4:
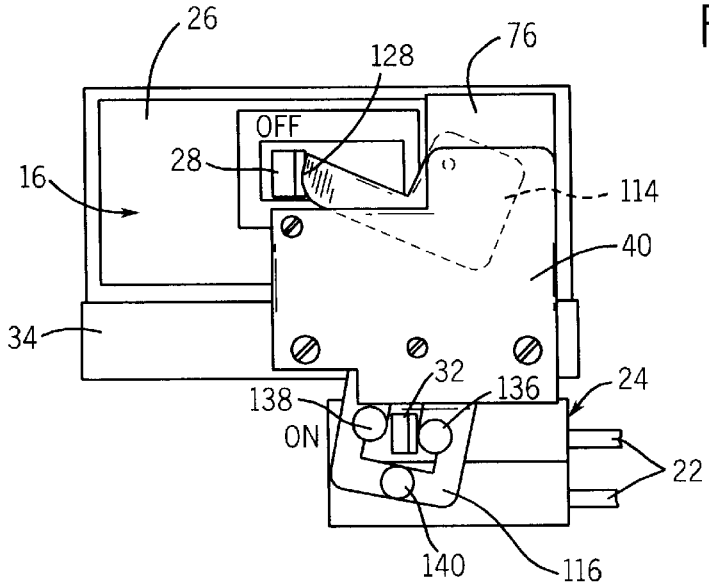
FIG. 4 is a view similar to FIGS. 2 and 3, where with the first switch moved to its OFF position, the interlock mechanism allows movement of the second switch member to its ON position and prevents movement of the first switch member to its ON position.

Mounting bracket 34 is a generally U-shaped member having an upper edge 42 and a lower edge 44 joined by a bight portion 46. Upper edge 42 is formed with at least one large opening 48 and a pair of spaced threaded openings 50, 52. As will be described later, the threaded openings 50, 52 form anchor points for attaching the base plate assembly 36 and the cover plate 40. Lower edge 44 has an aperture 54 in alignment with the large opening 48 and with a cylindrical spacer 56 having a passageway 58 provided therethrough. A threaded fastener 60 is passed through the large opening 48 in upper edge 42, the aperture 54 in lower edge 44 and the spacer 56, and is threadably received in a lower surface 62 adjacent the primary switch mechanism 16 as shown in FIG. 8. Upper edge 42 and lower edge 44 of mounting bracket 34 are suitably dimensioned such that their respective free ends 64, 66 will contact respective stepped upper and lower portions 68, 70 of the primary switch mechanism 16. In addition, the length of the mounting bracket 34 is slightly longer than the length of the primary switch mechanism 16 as illustrated in FIGS. 2, 3, and 4. Mounting bracket 34 may be a stamped and bent member formed of any satisfactory material, such as steel or aluminum, although it is understood that other materials or forming methods may be employed.

Base plate assembly 36 is a stacked plate formation comprised of a pair of generally planar, identical, lower spacer plates 72, 74, a generally planar, base plate 76 overlying the lower spacer plates 72, 74 and a generally planar, upper spacer plate 78 overlying a side extension portion of the base plate 76. Each of the lower spacer plates 72, 74, the base plate 76 and the upper spacer plate 78 are provided with aligned holes through which a pair of respective screws, 80, 82 are passed from the bottom and threaded into enlarged lower sides of a pair of cylindrical, spacer nuts 84, 86, respectively disposed upon the upper spacer plate 78. Each nut 84, 86 has a respective upper threaded crown 88, 90 which is reduced in diameter so as to support and retain the cover plate 40 in spaced relationship above the base plate assembly 36. In addition, the lower spacer plates 72, 74, the base plate 76 and the upper spacer plate 78 are formed with aligned holes which register with threaded opening 50 in upper edge 42 of the mounting bracket 34. It is noted that hole 92 in upper spacer plate 78 is slightly larger than the underlying holes so that a reduced diameter portion of a first, non-threaded, cylindrical spacer 94 sits in the hole 92 with the remainder of the spacer 94 projecting above the upper spacer plate 78. In like fashion, the base plate 76 has a slightly enlarged hole 96 overlying aligned holes in the lower spacer plates 72, 74 so that the reduced diameter portion of a second, non-threaded, cylindrical spacer 98 sits in hole 96 with the remainder projecting above the base plate 96. It will become clear that the spacer nuts 84, 86 and spacers 94, 98 function to hold the cover plate 40 elevated above the base plate assembly 36 and interlock assembly 38. The upper, right-hand section of base plate 76 also has an additional hole 100 defining a pivot point for the interlock assembly 38. A transverse, upper edge of base plate 76 is formed with a downwardly bent lip 102 which extends generally perpendicularly to the plane of base plate 76. Again, lower spacer plates 72, 74, base plate 76 and upper spacer plate 78 may be stamped members formed of any satisfactory material, such as steel or aluminum, although it is understood that other materials or forming methods may be employed. Base plate 76 may be bent as described or may be otherwise suitably formed.

As best seen in FIGS. 7 and 8, the base plate assembly 36 made up of lower spacer plates 72, 74, base plate 76 and upper spacer plate 78 is engaged with primary switch mechanism 16 by placing lip 102 of base plate 76 against an upper shoulder 104 of primary switch mechanism 16. A lower edge 106 of base plate 76 is aligned with corresponding lower edges 103, 105, 107, respectively of the lower spacer plates 72, 74 and upper spacer plate 78, and is engaged against an upper shoulder 108 on secondary switch mechanism 24. The length of the base plate 76, as measured along a first longitudinal edge 110, is suitably chosen such that the base plate assembly 36 will extend across the uppermost surfaces of the primary and secondary switch mechanisms 16, 24. The width of the base plate 76 is defined by a second longitudinal edge 112 which is aligned with corresponding edges 109, 111, 113, respectively, of the lower spacer plates 72, 74 and upper spacer plate 78.

With further reference to FIG. 7, interlock assembly 38 is a lever and linkage arrangement comprised of a first interlock member 114 pivotally mounted on the support arrangement 34, 36, a second interlock member 116 pivotally mounted on support arrangement 34, 36 and a linkage arm 118 interconnecting the first and second interlock members 114 and 116.

First interlock member 114 is a substantially planar member preferably in the form of a blocking lever having a foot structure provided with a downwardly depending pivot nub 120 and a laterally offset hole 122 which is aligned with hole 100 formed in underlying base plate 76. Blocking lever hole 122 has a slightly larger diameter than base plate hole 100 so that a lower reduced diameter portion of a pivot spacer 124 will sit in the latter hole 100 while an upper larger diameter portion of the spacer 124 will rest in the blocking lever hole 122. The spacer 124 defines a pivot point so that the blocking lever 114 rotates upon the base plate 76.

Blocking lever 114 is provided with engagement structure which is selectively in contact with various portions of the first switch handle 28 when the primary switch mechanism 16 is in its ON and OFF positions. More specifically, blocking lever 114 has a first or linear engagement surface 126 which is engageable with the underside of primary switch handle 28 when the primary switch handle 28 is in its ON position. Blocking lever 114 also has a second or curved engagement surface 128 which is engageable with one side of primary switch handle 28 when handle 28 is in its OFF position.

Second interlock member 116 is a substantially planar member preferably in the form of an actuating lever provided with a downwardly depending pivot nub 130 and a hole 132 laterally offset therefrom which is placed over the reduced diameter portion of the nut 86 on upper spacer plate 78. Hole 132 is appropriately sized such that the actuating lever 116 will pivot on nut 86. Actuating lever 116 is also formed with a generally, inverted, T-shaped window 134 for receiving the secondary switch handle 32. The window 134 is provided along its periphery with engagement post structure which is selectively in contact with various portions of the secondary switch handle 32 when the handle 32 is moved. The engagement post structure includes a first cylindrical engagement post 136 disposed on one side of the window 134 and engageable with one side of the secondary switch handle 32, and a second cylindrical engagement post 138 disposed on the other side of the window 134 and engageable with the other side of the secondary switch handle 32. A third cylindrical engagement post 140 (which may have a greater height than the other posts 136, 138) is positioned at the bottom periphery of the window 134 and is adapted to be engaged by a user's hand when it is desired to move secondary switch handle 32 by moving actuating lever 116.

Linkage arm 118 is a substantially planar member preferably in the form of an elongated bar having an upper end 142 provided with an aperture 144 for receiving pivot nub 120 on blocking lever 114, and a lower end 146 provided with an aperture 148 for receiving pivot nub 130 on actuating lever 116. The linkage arm 118 slides upon the base plate 76 and acts to transmit a force selectively applied to the secondary switch handle 32 by actuating lever 116 to blocking lever 114 such that the primary and secondary switch handles 28, 32 are never simultaneously in their ON position as will be described more fully hereafter.

Figure 9:
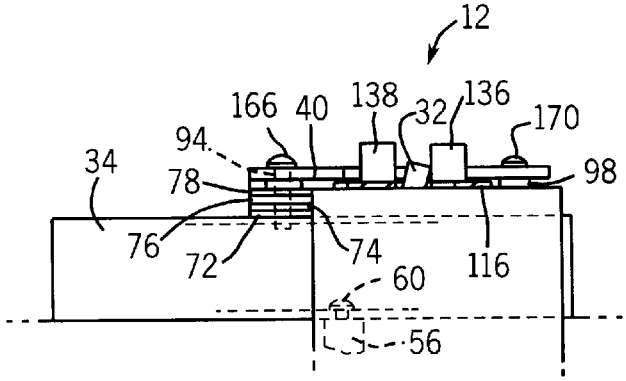
FIG. 9 is a sectional view taken on line 9—9 of FIG. 2.

Cover plate 40 is a substantially planar member adapted to be removably secured to mounting bracket 34 and base plate 36 in spaced relationship to the interlock assembly 38. Cover plate 40 has a first longitudinal edge 150 which is aligned with base plate first longitudinal edge 110. A second longitudinal edge 152 is aligned with base plate second longitudinal edge 112 and corresponding, respective, upper and lower spacer plate edges 109, 111 and 113. A lower edge 154 is aligned with corresponding lower edges 103, 105, 106, 107, respectively, of the lower spacer plates 72, 74, base plate 76 and the upper spacer plate 78. Cover plate 40 has a first opening 156 and a second opening 158 which receive the respective upper reduced diameter portions of spacer nuts 84, 86, and rests upon the respective lower increased diameter portions thereof. Threaded fasteners 160, 162 are passed through the cover plate openings 156, 158 and screwed into upper portions of the spacer nuts 84, 86, respectively. Cover plate 40 has a third opening 164 which is aligned with the passageway in upper spacer plate spacer 94 and is supported on the increased diameter upper portion thereof. A screw 166 is inserted through opening 164 and the passageway of spacer 94, and is turned into threaded opening 50 in mounting bracket 34. A fourth opening 168 in cover plate 40 is aligned with the passageway in spacer 98 on base plate 76. Cover plate 40 is supported upon the increased upper diameter portion of spacer 98. A screw 170 is inserted through opening 168 and the passageway in spacer 98, and turned into the other threaded opening 52 in mounting bracket 34. As shown in FIG. 9, the spacers 94, 98 and spacer nuts 84, 86 thus permit the cover plate 40 to be anchored to the stationary support arrangement 34, 36 in a raised position over the movable interlock assembly 38.

Blocking lever 114, actuating lever 116, linkage arm 118 and cover plate 40 may be stamped members formed of any satisfactory materials, such as steel or aluminum, although it is understood that other materials or forming methods may be employed.

Interlock mechanism 12 is assembled as described above, by attaching the mounting bracket 34 to lower surface 62, positioning the base plate assembly 36 between the primary and secondary switch mechanisms 16, 24 such that the various holes and openings in the mounting bracket 34 and assembly 36 are properly aligned, pivotally mounting the blocking lever 114, actuating lever 116 and linkage arm 118 upon the base plate assembly 36 and then anchoring the cover plate 40 using the fasteners 160, 162, 166 and 170. Alternatively, interlock mechanism 12 can be preassembled and held together with fasteners 160, 162. The complete assembly can then be attached to mounting bracket 34 using fasteners 166, 170.

Figure 5:
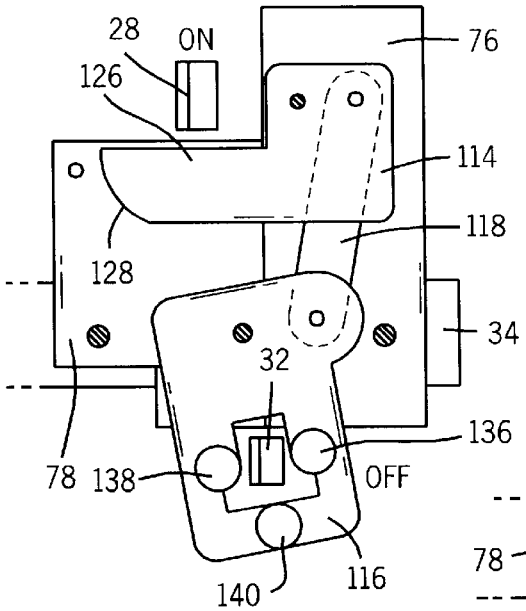
FIG. 5 is a view similar to FIG. 2, showing a cover plate removed from the interlock mechanism.

In operation, interlock mechanism 12 functions to prevent primary and secondary switch mechanisms 16, 24 from being in the ON position at the same time. With reference to FIGS. 2, 5, and 9, with primary switch handle 28 in its ON position and secondary switch handle 32 in its OFF position, first engagement surface 126 on blocking lever 114 is held in close proximity to the underside of primary switch handle 28, and first engagement post 136 on actuating lever 116 is engaged against one side of the secondary switch handle 32. Slight movement of the secondary switch handle 32 away from its OFF position, such as by grasping the third engagement post 140 on actuating lever 114 and applying a force to the left, will transmit such force through the linkage arm 118 to rotate the blocking lever 114 in a clockwise direction to a first interlock position (FIG. 3) in which the first engagement surface 126 on blocking lever 114 will contact the underside of switch handle 28. However, once the blocking lever 114 is engaged with primary switch handle 28 in this manner, further movement of the secondary switch handle 32 towards its ON position is prevented by the interlock assembly 38.

Figure 6:
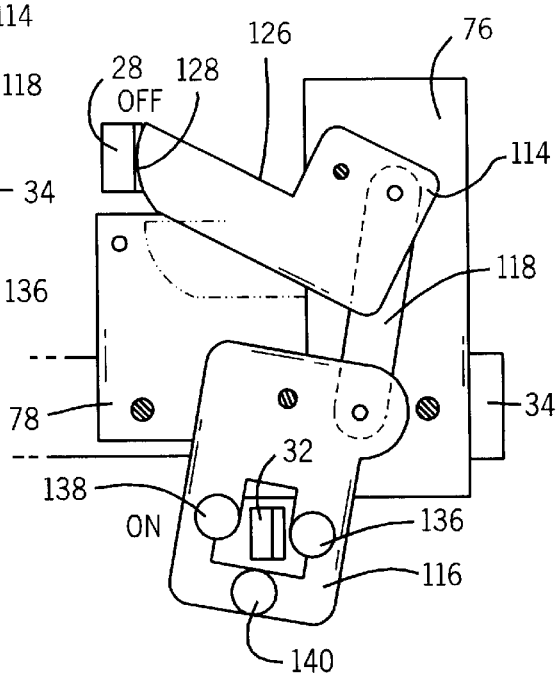
FIG. 6 is a view similar to FIG. 4, showing the cover plate removed from the interlock mechanism.

When it is desired to move secondary switch handle 32 to its ON position, primary switch handle 28 is first moved to its OFF position, as shown in FIGS. 4 and 6. When primary switch handle 28 is in its OFF position, primary switch handle 28 is located outwardly of the outer end of blocking lever 114. A lateral force is then applied on the actuating lever 116 or secondary switch handle 32 in a leftward direction, to push secondary switch handle 32 from its OFF position toward its ON position. The force may either be applied directly to secondary switch handle 32, or may be applied to actuating lever 116 to engage secondary switch handle 32 through engagement post 136. In either case, continued application of the lateral leftward force shifts the actuating lever 116 in a clockwise direction, which transmits the force through the linkage arm 118 to rotate the blocking lever 114 in a clockwise direction to a second interlock position in which the second engagement surface 128 is in line with primary switch handle 28, to prevent movement of primary switch handle 28 towards its ON position. Movement of the interlock assembly 38 enables continued movement of the secondary switch handle 32 towards its ON position. It should be noted that while blocking lever 114 and actuating lever 116 are each engageable with their respective primary and secondary switch handles 28, 32, only the actuating lever 116 is tied to or movable with secondary switch handle 32 at all times.

While secondary switch handle 32 is in its OFF position, primary switch handle 28 may also be freely moved to its OFF position from its ON position of FIG. 2 so that both the primary and secondary switch handles 28 and 32 may be in the OFF position simultaneously.

It can thus be appreciated that interlock mechanism 12 provides a simple and efficient mechanism for preventing two switches which are movable in parallel directions and are laterally offset from each other from being in an ON position at the same time. The components of interlock mechanism 12 are relatively inexpensive to manufacture and assemble, and take advantage of the existing switch body and handle structure to secure the components of interlock mechanism 12 to each other and to the switches. Interlock mechanism 12 can either be installed during original assembly of electrical panel assembly 10 or can be retrofit after assembly if an existing electrical panel is being outfitted with a secondary source of power.

While interlock assembly 12 has been shown and described with respect to an electrical panel assembly, it should be understood that interlock mechanism 12 could be used in any other application in which it is desired to interlock two switches or switch handles which are oriented relative to each other such that movement of the switch handles is parallel.

Various alternatives and embodiments are contemplated as being within the scope of the following claims particularly pointing out and distinctly claiming the subject matter regarded as the invention.

I claim:

1. An electrical panel adapted for interconnection with first and second sources of electrical power for supplying electrical power to the electrical panel, comprising:

a first switch mechanism having a first manually operable switch handle movable in a first direction between an ON position and an OFF position for controlling the supply of electrical power to the electrical panel from the first power source;

a second switch mechanism having a second manually operable switch handle, wherein the second switch handle is laterally offset from the first switch handle and is movable in a direction having a component parallel to the first direction, between an ON position and an OFF position for controlling the supply of electrical power to the electrical panel from the second power source; and an interlock mechanism interconnected between the first switch mechanism and the second switch mechanism, wherein the interlock mechanism includes: an interlock member movable between an interlock position in which the interlock member engages the first switch handle to prevent movement of the first switch handle from the OFF position to the ON position, and an inoperative position in which the interlock member enables the first switch handle to be moved from the OFF position to the ON position; and an actuator mechanism movable with the second switch handle between the ON and OFF positions; wherein the actuator mechanism is interconnected with the interlock member and is constructed and arranged to place the interlock member in the interlock position when the second handle mechanism is in the ON position, and to place the interlock member in the inoperative position when the second switch handle is in the OFF position;

wherein the interlock assembly is mounted to a support arrangement interconnected with the first and second switch mechanisms, wherein the support arrangement includes a mounting bracket secured to one of the switch mechanisms, a base plate assembly to which the interlock assembly is mounted and which is supported by the mounting bracket, and a cover plate attached to the base plate assembly and the mounting bracket in spaced relationship above the interlock assembly, wherein the base plate assembly includes lower spacer plate structure, a base plate overlying the lower spacer plate structure and upper plate structure overlying a portion of the base plate.

2. An electrical panel adapted for interconnection with first and second sources of electrical power for supplying electrical power to the electrical panel, comprising:

a first switch mechanism having a first manually operable switch handle movable in a first direction between an ON position and an OFF position for controlling the supply of electrical power to the electrical panel from the first power source;

a second switch mechanism having a second manually operable switch handle, wherein the second switch handle is laterally offset from the first switch handle and is movable in a direction having a component parallel to the first direction, between an ON position and an OFF position for controlling the supply of electrical power to the electrical panel from the second power source; and an interlock mechanism interconnected between the first switch mechanism and the second switch mechanism, wherein the interlock mechanism includes:

an interlock member movable between an interlock position in which the interlock member engages the first switch handle to prevent movement of the first switch handle from the OFF position to the ON position, and an inoperative position in which the interlock member enables the first switch handle to be moved from the OFF position to the ON position; and an actuator mechanism movable with the second switch handle between the ON and OFF positions, wherein the actuator mechanism is interconnected with the interlock member and is constructed and arranged to place the interlock member in the interlock position when the second switch mechanism is in the ON position, and to place the interlock member in the inoperative position when the second switch mechanism is in the OFF position;

wherein the interlock member comprises a pivotable blocking lever, and wherein the actuator mechanism comprises a pivotable actuating lever and a linkage arm interconnecting the blocking lever and the actuating lever.

3. The electrical panel of claim 2, wherein the actuator mechanism includes an actuator member defining an opening within which the second switch handle is received.

4. The electrical panel of claim 2, wherein the interlock assembly is mounted to a support arrangement interconnected with the first and second switch mechanisms.

5. The electrical panel of claim 4, wherein the support arrangement includes a mounting bracket secured to one of the switch mechanisms, a base plate assembly to which the interlock assembly is mounted and which is supported by the mounting bracket, and a cover plate attached to the base plate assembly and the mounting bracket in spaced relationship above the interlock assembly.

6. The electrical panel of claim 2, wherein the blocking lever has a first engagement surface engageable with the first switch handle when the first switch mechanism is in the ON position preventing movement of the second switch handle to the ON position, and has a second engagement surface engageable with the first switch handle when the first switch mechanism is in the OFF position and the blocking lever is in the interlock position, for preventing movement of the first switch handle to the ON position.

7. The electrical panel of claim 2, wherein the actuating lever is formed with a window for receiving the second switch handle, wherein the window defines a periphery and is provided along the periphery with a first engagement post engageable with one side of the second switch handle, a second engagement post engageable with another side of the second switch handle, and a third engagement post manually engageable by a user to move the second switch handle by means of moving the actuating lever.

8. An electrical panel adapted for interconnection with first and second sources of electrical power for supplying electrical power to the electrical panel, comprising:

a first switch mechanism interconnected with the electrical panel, and including a first manually operable switch handle movable in a first direction between an ON position and an OFF position for controlling the supply of electrical power to the electrical panel from the first power source;

a second switch mechanism interconnected with the electrical panel and including a second manually operable switch handle movable in a direction having a component parallel to the first direction, between an ON and an OFF position for controlling the supply of electrical power to the electrical panel from the second power source; and an interlock mechanism interconnected between the first switch handle and the second switch handle for preventing movement of the second switch handle to the ON position when the first switch handle is in the ON position, and for preventing movement of the first switch handle to the ON position when the second switch handle is in the ON position, the interlock mechanism including:

support structure engageable with the first and second switch mechanisms;

a first interlock member pivotally mounted to the support structure and engageable with the first switch handle;

a second interlock member pivotally mounted to the support structure and engageable with the second switch handle and movable therewith; and a linkage arm interconnecting the first and second interlock members, wherein the first and second interlock members include engagement structure for preventing movement of the second switch handle to the ON position when the first switch handle is in the ON position, and for preventing movement of the first switch handle to the ON position when the second switch handle is in the ON position.

9. In an electrical panel including a first switch mechanism having a first switch member movable in a first direction between an ON position and an OFF position for controlling electrical power supplied from a first power source, the improvement comprising:

a second switch mechanism including a second switch member movable in a direction having a component parallel to the first direction between an ON position and an OFF position for controlling the supply of electrical power from an alternate power source; and an interlock mechanism interposed between the first and second switch mechanisms, comprising a movable first interlock member engageable with the first switch member, and a second interlock member engageable with the second switch member and movable therewith, wherein the first and second interlock members are movably mounted to a support arrangement and are interconnected by a linkage arm, and wherein the first and second interlock members include engagement structures which are configured and arranged to prevent movement of the second switch member to the ON position when the first switch member is in the ON position, and to prevent movement of the first switch member to the ON position when the second switch member is in the ON position, wherein the first interlock member includes a blocking lever including foot structure engageable with the first switch member, and wherein the second interlock member comprises an actuating lever having engagement structure selectively engageable with the second switch member, and wherein the linkage arm interconnects the blocking lever and the actuating lever to transfer motion from the second switch mechanism and the actuating lever movable therewith to the blocking lever.

10. The improvement of claim 9, wherein when the first switch member is moved to the OFF position, a first engagement surface of the foot structure is engageable with the first switch member when the second switch member is in the ON position to prevent movement of the first switch member to the ON position.

11. The improvement of claim 10, wherein the foot structure of blocking lever defines a second engagement surface engageable with the first switch member for preventing movement of the second switch member to the ON position when first switch member is in the ON position.

12. The improvement of claim 9, wherein the engagement structure of the actuating lever includes a window through which the second switch member projects, the window having a periphery provided with at least two spaced engagement posts, each of the engagement posts being engageable with a side of the second switch member when the actuating lever is moved, wherein the movement of the actuating lever is transmitted through the linkage arm to move the blocking lever relative to the first switch member to prevent both the first and second switch members from being in the ON position at the same time.

13. The improvement of claim 12, wherein the first and second interlock members are pivotally mounted to the support arrangement, and wherein the support arrangement includes a mounting bracket attached to one of the switch mechanisms, a base plate assembly to which the first and second interlock members are pivotally mounted and which is supported by the mounting bracket, and a cover plate secured to the base plate assembly and the mounting bracket in spaced relationship above the first and second interlock members.

14. A parallel direction switch interlock for first and second switch members, wherein the first switch member is movable in a first direction to an ON position and the second switch member is movable in a direction parallel to the first direction to an ON position, comprising:

a support;

a first interlock member pivotally interconnected with the support;

a second interlock member pivotally interconnected with the support and movable along with the second switch member;

a link member interconnecting the first and second interlock members; and an engagement structure associated with the first interlock member for preventing movement of the second interlock member when the first switch member is in the ON position, to prevent movement of the second switch member to the ON position, and for allowing movement of the second interlock member when the first switch member is in the OFF position, to allow movement of the second switch member to the ON position.

15. The switch interlock of claim 14, wherein the first interlock member includes a first engagement surface and a second engagement surface and wherein, when the first switch member is in the ON position, the first engagement surface is engageable with a first area of the first switch member to thereby prevent movement of the second switch member to the ON position, and wherein the second engagement surface is engageable with a second area of the first switch member when the first switch member is in the OFF position so as to permit movement to thereby enable the second switch member to be moved to the ON position.

16. The switch interlock of claim 15, wherein the second interlock member includes a first engagement post engageable with one side of the second switch member, a second engagement post engageable with another side of the second switch member and a third engagement post engageable by a user to move the second switch member by means of the second interlock member whereby, when the first switch member is in the ON position, movement of the second switch member from the OFF position causes the first engagement post of the second interlock member to contact the second switch member, wherein movement of the second interlock member transmits a force via the link member to move the first engagement surface of the first interlock member into engagement with the first switch member to prevent further movement of the second switch member to the ON position, and when the first switch member is in the OFF position, such movement of the second switch members causes another side of the second switch member to contact the second engagement post to shift and transmit a force via the link member to move the second engagement surface of the first interlock member into the path of movement of the first switch member to enable the second switch member to move to the ON position and to prevent movement of the first switch member to the ON position.

17. A method of selectively preventing movement of first and second switch mechanisms which are movable in substantially parallel directions, comprising the steps of:

mounting a support arrangement in the vicinity of the first and second switch mechanisms;

pivotally mounting a first interlock member on the support arrangement so that the first interlock member is selectively engageable with the first switch mechanism;

pivotally interconnecting a second interlock member on the support arrangement so that the second interlock member is movable with the second switch mechanism;

interconnecting the first interlock member and the second interlock member with a link member so that movement of the second switch mechanism and the second interlock member is transferred to the first interlock member; and providing engagement structure associated with the first interlock member for preventing movement of the second interlock member when the first switch member is in the ON position, to prevent movement of the second switch member to the ON position, and for allowing movement of the second interlock member when the first switch member is in the OFF position, to allow movement of the second switch member to the ON position.

18. An electrical panel adapted for interconnection with first and second sources of electrical power for supplying electrical power to the electrical panel, comprising:

a first switch mechanism switchable in a first direction between an ON position and an OFF position for controlling the supply of electrical power to the electrical panel from the first power source;

a second switch mechanism switchable in a second direction substantially parallel to the first direction, between an ON position and an OFF position for controlling the supply of electrical power to the electrical panel from the second power source; and interlock means for preventing switching of the second switch mechanism to the ON position when the first switch mechanism is in the ON position, and preventing switching of the first switch mechanism to the ON position when the second switch mechanism is in the ON position, wherein the interlock means includes first and second interlock members interconnected by a link member, and wherein the interlock members are constructed and arranged to selectively engage the first and second switch mechanisms to prevent both the first and second switch mechanisms from being in the ON position at the same time.

* * * * *